US007196614B2

(12) United States Patent
Carolan

(10) Patent No.: US 7,196,614 B2
(45) Date of Patent: Mar. 27, 2007

(54) GUIDANCE SYSTEM FOR RESCUE PERSONNEL

(76) Inventor: Joseph P. Carolan, 63 Beach St., Rockaway, NJ (US) 07866

( * ) Notice: Subject to any disclaimer, the term of this patent is extended or adjusted under 35 U.S.C. 154(b) by 127 days.

(21) Appl. No.: 10/888,204

(22) Filed: Jul. 9, 2004

(65) Prior Publication Data

US 2005/0030191 A1 Feb. 10, 2005

Related U.S. Application Data

(60) Provisional application No. 60/486,209, filed on Jul. 11, 2003.

(51) Int. Cl.
*G08B 5/00* (2006.01)

(52) U.S. Cl. ..... 340/332; 340/815.4; 340/815.56; 340/815.57; 340/815.65; 340/5.32

(58) Field of Classification Search ..... 340/332, 340/815.56, 815.57, 815.65, 425.5, 545.6, 340/545.7, 545.8, 545.9, 506, 540, 5.32, 340/7.55, 7.56, 815.4
See application file for complete search history.

(56) References Cited

U.S. PATENT DOCUMENTS

| | | | | |
|---|---|---|---|---|
| 5,278,732 | A | 1/1994 | Frankum | |
| 6,060,838 | A * | 5/2000 | Cantoni et al. | 315/159 |
| 6,257,750 | B1 * | 7/2001 | Strasser et al. | 362/559 |
| 2004/0030531 | A1 * | 2/2004 | Miller et al. | |
| 2004/0251679 | A1 * | 12/2004 | Brignull | |
| 2004/0267685 | A1 * | 12/2004 | Sharland et al. | |

OTHER PUBLICATIONS

Alert-All, The Leader in Fire Safety Education, [online],[retrieved on Oct. 11, 2005]. Retrieved from the Internet <URL::ttp://www.alertall.com/store/singlelist.asp?Id=113>.
Tot Finder.com, Tot Finder™ Fire Safety Program, [online], [retrieved on Oct. 11, 2005]. Retrieved from the Internet <URL:http://www.totfinder.com/faq.asp>.
Tot Finder.com, Tot Finder™ Fire Safety Program [online], [retrieved on Oct. 11, 2005]. Retrieved from the Internet <URL:http://www.totfinder.com/totfinder.asp>.

(Continued)

*Primary Examiner*—Hung Nguyen
(74) *Attorney, Agent, or Firm*—Synnestvedt & Lechner LLP; Gregory S. Bernabeo

(57) ABSTRACT

A guidance device including a body having multiple reflective fields, and a mounting member for secure mounting to a surface. The body's reflective surfaces may be oriented to reflect approaching light from the top, bottom, left, and right, thereby enhancing its visibility regardless of an approach mode of rescue personnel, and regardless of an orientation in which the guidance device is mounted. The guidance device may include an element capable of absorbing heat to enhance the guidance device's detection by a thermal imaging camera, or be configured to cause emission of light from responsive to detection of light (e.g. from a firefighter's flashlight). One or more guidance devices may be sold as part of a kit that includes an identification marker mountable adjacent an entry door of a building, and instructions for coordinating mounting positions of the identification marker and the guidance device relative to their respective doors.

26 Claims, 7 Drawing Sheets

OTHER PUBLICATIONS

Tot Finders, Fire Safety & Apparel, Inc. [online], [retrieved on Jan. 30, 2006]. Retrieved from the Internet <URL: http://www.firebrakeco.com/inc/sdetail/507>.

The New York Firefighters Burn Center Foundation, Tot Finder Program [online], [retrieved on Feb. 6, 2006]. Retrieved from the Internet<URL: http://www.nyffburncenter.com/inca/totfinder.htm>.

Tot Finder™ Fire Safety Program [online], [retrieved on Feb. 7, 2006]. Retrieved from the Internet <URL: http://www.totfinder.com/images/totfinder-lg.jpg>.

The New York Firefighters Burn Center Foundation, [online], [retrieved on Jul. 11, 2006]. Retrieved from the Internet <URL:http://www.nyffburncenter.com/incs/events.htm.

* cited by examiner

RESCUE PERSONNEL'S PERSPECTIVE

GUIDANCE SYSTEM FOR RESCUE PERSONNEL

CROSS-REFERENCE TO RELATED APPLICATIONS

This application claims the benefit of U.S. patent application Ser. No. 60/486,209, filed Jul. 11, 2003, the entire disclosure of which is hereby incorporated herein by reference.

FIELD OF THE INVENTION

The present invention relates generally to the field of firefighting and search and rescue efforts made by firefighters and other rescue personnel when entering a smoke-filled or burning building, and more particularly to a device and method for guiding rescue personnel to a location of a potential fire victim.

BACKGROUND

Residential fires occur with alarming frequency. Not only are residences constructed of many flammable materials, but relatively recent developments in residential construction compound the inherent fire risk. For example, increasingly popular wooden truss-based construction includes metal plates that conduct heat between truss members, resulting in sudden collapse when critical truss members give way. Additionally, there has been an increased use of micro-laminate and pressed board flooring materials, which include adhesives that cause fires to burn faster and hotter. Further, prevalent heat-retaining thermal pane windows, while energy-efficient, pose an increased hazard in a residential fire, causing hotter environments and contributing to flash over. As a result of these constructions, structural deterioration in residential fires occurs more rapidly than ever before, and the need to locate potential fire victims quickly is even more urgent as a result.

It is estimated that, in the United States alone, more than 25,000 people are injured and 4,000 are killed in fires each year, many of which occur in residences. Of those injured, approximately 2,800 are children that are fourteen years of age or younger; an additional 850 such children are killed in residential fires each year. Of these children, it is estimated that more than 40% are under the age of 5, and 70% are under the age of 10. It has been found that most residential fires originate in a bedroom, where fire victims often succumb to smoke inhalation. Too often, victims are injured or perish before they can be found and rescued by rescue personnel.

Conventionally, an outward-facing window sticker has been placed on a window pane of a child's bedroom, so that such a sticker could be spotted by rescue personnel in the event of a residential fire. However, such stickers have been used by predators and pedophiles to locate and abduct sleeping children. Accordingly, such externally visible stickers have fallen out of favor.

As a result, virtually all search and rescue operations in smoke-filled and/or burning buildings rely on a search procedure in which a firefighter, etc. enters the building, sweeps behind the entry door for a victim, then follows a wall to the right or left of the door while sweeping the whole room, until a doorway is reached and entered, and the process is repeated for the next room. While this technique is effective, it is inefficient and time-consuming.

SUMMARY

In an effort to save lives, the inventor, a veteran firefighter, has developed a unique guidance device and method that assist rescue personnel in quickly locating potential fire victims by guiding such rescue personnel to bedrooms and/or other areas where most potential fire victims become trapped.

An exemplary guidance device includes a body having multiple reflective fields, each having unique light-reflective characteristics, and a mounting member, such as adhesive backed tape, for securely mounting the guidance device to a surface. Preferably, the reflective field includes reflective surfaces that are oriented to reflect light approaching the guidance device from the top, bottom, left, and right, thereby enhancing visibility of the guidance device to rescue personnel regardless of how such personnel's flashlight, etc. is carried, and regardless of whether the rescue person is walking, crawling, etc. Optionally, the surfaces are arranged symmetrically about a plane, or two perpendicular planes.

In one embodiment, the guidance device also includes an element capable of absorbing heat to enhance the guidance device's detection by a thermal imaging camera. In another embodiment, the guidance device includes a light or sound source connected to a power source, a light sensor for detecting light, and circuitry configured to cause emission of light or sound from the light or sound sources responsive to detection of light (e.g. from a firefighter's flashlight) by the light sensor.

One or more guidance devices may be sold as part of a kit that also includes an identification marker capable of being mounted adjacent an entry door of a building. The identification marker may include text or other visually perceptible indicia providing notice that the building contains at least one guidance device. Optionally, the kit may also include instructions bearing indicia advising an installer to mount the guidance device and the identification marker in similar positions relative to their respective doors, so that the marker can serve as notice of where to expect guidance devices within the building.

Methods for installing the guidance devices and for searching for potential fire victims in a building using such guidance devices are also provided.

BRIEF DESCRIPTION OF THE DRAWINGS

The present invention will now be described by way of example with reference to the following drawings in which.

DETAILED DESCRIPTION

The present invention provides a guidance device for guiding rescue personnel during search and rescue efforts in smoke-filled or burning buildings, to assist such rescue personnel to quickly locate potential fire victims.

Figure 1:
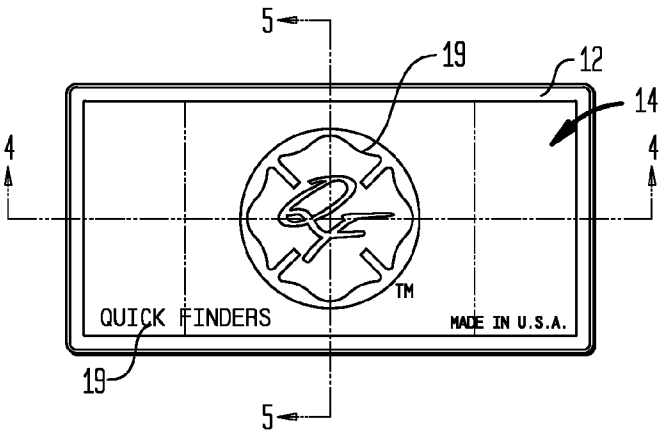
FIG. 1 is a top view of an exemplary body of an exemplary guidance device in accordance with the present invention, showing top surface detail.
Figure 2:
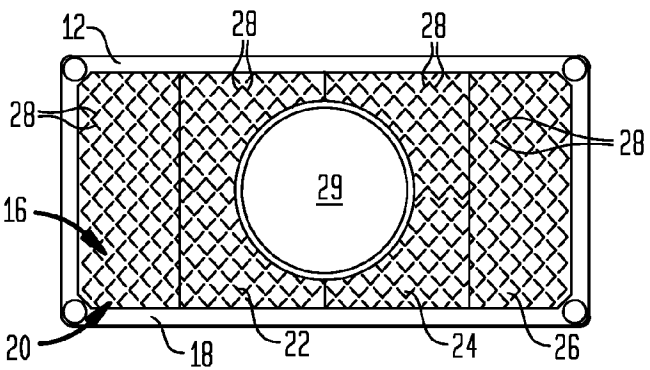
FIG. 2 is a bottom view of the body of FIG. 1, showing reflective structures.
Figure 3:
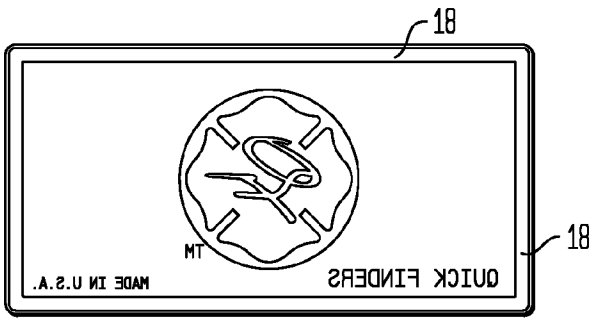
FIG. 3 is a bottom view of the body of FIG. 1, with the reflective structures omitted for illustrative purposes.
Figure 4:
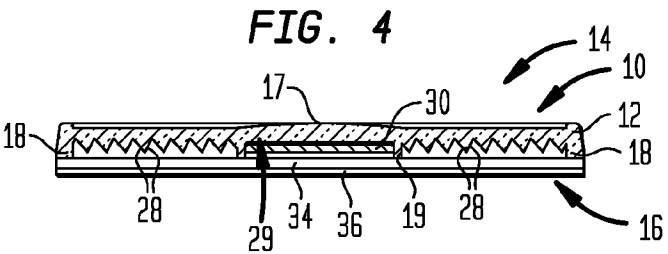
FIG. 4 is a cross-sectional view of a guidance device including the body of FIG. 1, taken along line 4—4 of FIG. 1.

Referring now to FIGS. 1–5, a preferred embodiment of an exemplary guidance device 10 is shown. As shown in FIGS. 1–5, the exemplary guidance device 10 includes a body 12 including a top side 14 and a bottom side 16. The bottom side preferably includes a flange 18 extending around the perimeter of the body, as best shown in FIGS. 2 and 4. The body 12 is preferably formed as a unit by an injection molding process using an acrylic or general purpose polycarbonate material, such material being capable of maintaining structural integrity at temperatures higher than human life can survive, e.g. 310° F. Preferably, the body is clear/translucent acrylic to complement most home interiors, and includes trademark, logo and/or name 19 molded into the body to assure compliance with applicable quality standards, as best shown in FIG. 1.

The body 12 includes multiple reflective fields, at least two of which have different reflective properties. As best shown in FIG. 2, the exemplary body includes multiple reflective fields 20, 22, 24, 26. Each reflective field includes one or more pluralities of reflective surfaces 28, each of which is disposed at a certain orientation relative to the body 12. The reflective fields collectively include surfaces at various orientations relative to the body, so that multiple reflective properties are provided by such surfaces to the body 12. Such surfaces are preferably provided on the bottom side 16 of the body, so that the body may be provided with a substantially smooth upper surface 14. These reflective surfaces are typically part of reflective structures in the form of tiny 3-sided pyramids or cube corners, as well known in the art.

Exemplary reflective surfaces 28 are best shown in FIGS. 2, 2A–2H, 4 and 5. By way of further example, the surfaces 28 are preferably similarly oriented relative to the top surface 14 of the body 12 within a respective reflective field 20, 22, 24, 26, and are uniquely oriented with respect to the others of the multiple reflective fields 20, 22, 24, 26, so that at least two fields provide unique reflective characteristics in that they reflect light from a unique direction, angle, or range of angles. In the exemplary body of FIGS. 1–5, the first reflective field 20 includes a wide angle reflector having surfaces 28 arranged to have a brightest reflectivity for light approaching from 45 degrees to 65 degrees (from a plane of the body) from the left of the body (from the perspective of FIG. 1), and approximately 85 degrees to 90 degrees from the top and bottom of the body (from the perspective of FIG. 1). The surfaces of the fourth reflective field 26 are essentially a mirror image of those of the first reflective field; accordingly, the fourth reflective field 26 includes a wide angle reflector having surfaces 28 arranged to have a brightest reflectivity for light approaching the body 21 from 45 degrees to 65 degrees from the right of the body, and approximately 85 degrees to 90 degrees from the top and bottom of the body. Each of the second and third reflective fields 22, 24 includes an HV (horizontal-vertical) flat reflector, and includes surfaces arranged to have a brightest reflectivity for light approaching the body 21 from approximately 75 degrees to 90 degrees from the top, bottom, left and right of the body (e.g. the boundary defining a generally cone-shape). In this particular embodiment, the second and third fields 22, 24 are mirror images of one another, but provide identical reflective characteristics, such that the second and third reflective fields operate as a single reflector having a uniform reflective characteristic. Accordingly, the first and fourth fields 20, 26 primarily reflect light approaching from the left and right sides of the body, and the second and third fields 22, 24 reflect light approaching from the top, bottom, left and right sides, providing a wide range of visibility of the guidance device in three dimensional space. Accordingly, in these and other configurations, the guidance device 10 may be easily detected by a firefighter, e.g. when carrying a flashlight and/or sweeping it's beam during a search process, from a variety of angles, e.g. when the firefighter is carrying a handheld, coat-mounted or helmet-mounted flashlight, when the firefighter is walking or crawling, etc.

Figure 5:
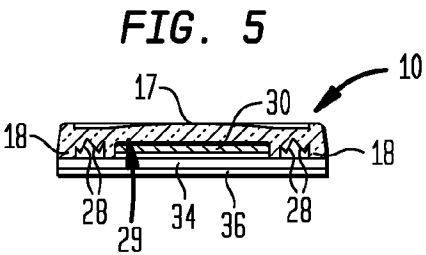
FIG. 5 is a cross-sectional view of the guidance device of FIG. 4, taken along line 5—5 of FIG. 1.
Figure 2C:
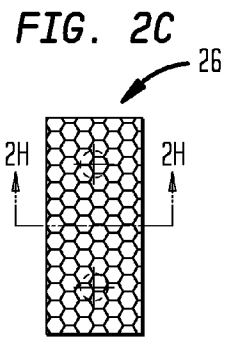
FIGS. 2A, 2B and 2C are collectively an exploded view of the body of FIG. 2.
Figure 2H:
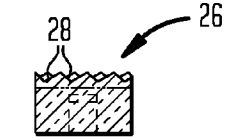
FIG. 2H is a cross-sectional view of the body portion of FIG. 2C, taken along line 2H—2H of FIG. 2C.
Figure 2B:
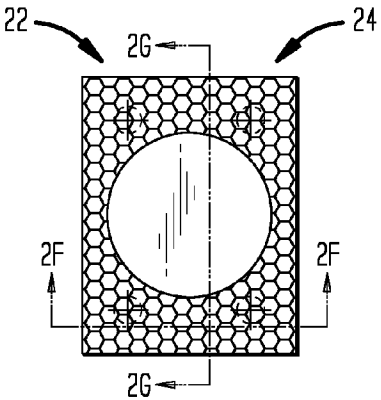
Figure 2F:
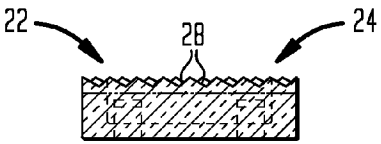
FIGS. 2F and 2G are cross-sectional views of the body portions of FIG. 2B, taken along lines 2F—2F and 2G—2G of FIG. 2B, respectively.
Figure 2G:
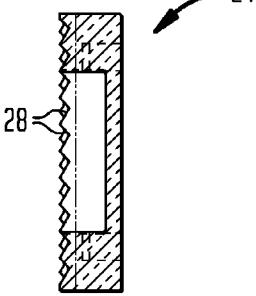
Figure 2A:
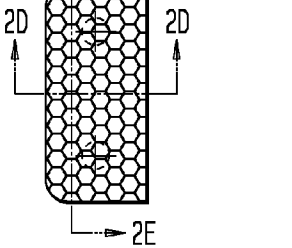
Figure 2D:
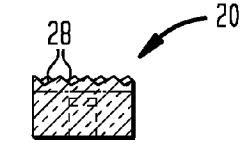
FIGS. 2D and 2E are cross-sectional views of the body portion of FIG. 2A, taken along lines 2D—2D and 2E—2E of FIG. 2A, respectively.
Figure 2E:
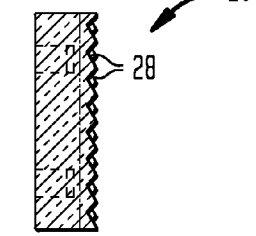

In a certain embodiment of the present invention, the guidance device 10 further includes an element capable of absorbing and retaining heat, such that it will be easily detected through use of a thermal imaging camera of a type commonly used by firefighters, etc. For example, a metal disc 30, as shown in FIGS. 4 and 5, capable of absorbing and retaining heat at a rate greater than the material of the body 12 is preferable. By way of example, a disc constructed of nickel-plated steel that is approximately 0.89 inches in diameter and approximately 0.05 inches thick has been found suitable for this purpose. Optionally, the body 12 is formed to include a recess 29 dimensioned to receive and retain the element/disc 30, as best shown in FIGS. 2, 4 and 5. In such an embodiment, the body 12 may include a dome 17 for housing the metal disc, etc., as best shown in FIGS. 4 and 5.

In another embodiment, the guidance device 10 includes an electronic device capable of emitting a beam or flash of light, or an audible signal, when a sensor thereof is activated by a firefighter's flashlight, etc. The fabrication of circuitry that will emit a beam of light or audible signal upon activation by a light beam is within the ability of the ordinarily skilled artisan and requires no further description. In such an embodiment, the disc 30 is replaced with such circuitry and disc style batteries. Advantageously, even if such batteries are discharged and the electronic device is not functioning, they may nevertheless function as a suitable element for the thermal imaging purposes described above. In such an embodiment, the guidance device may also include a mounting plate (not shown) having apertures for admitting passage of screws for mounting the mounting plate to a wall, etc., and the body may be configured to snap on or otherwise be fastened to the mounting plate. Any suitable mounting may be used.

The guidance device 10 further includes mounting means mounted to the bottom side 14 of the body. In the exemplary embodiment, such mounting means includes double-faced adhesive tape 34, as best shown in FIGS. 4 and 5. The tape 34 is preferably adhered to the flange 18 of the body 12 and any flange adjacent any recess 15, as shown in FIGS. 4 and 5, and/or any internal portions of the reflective structures/surfaces (not shown). The tape 34 serves to retain any disc 30 circuitry etc., relative to the body 12. Further, on opposite side of the tape 34 is preferably provided with a release sheet 36 that may be easily peeled away to expose adhesive that can be used to securely mount the guidance device 10 to a residential structure, as shown in FIGS. 4 and 5.

Figure 6:
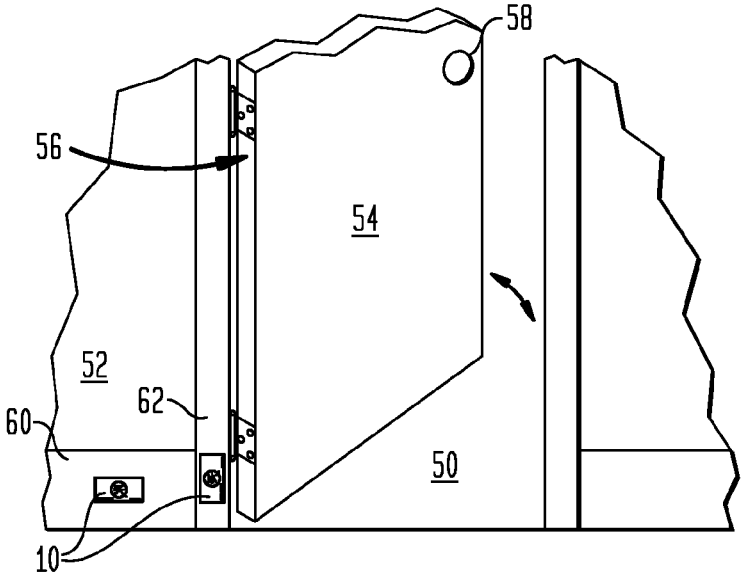
FIG. 6 is an elevational view showing an exemplary mounting of the guidance device in a residence, in accordance with the present invention.
Figure 7:
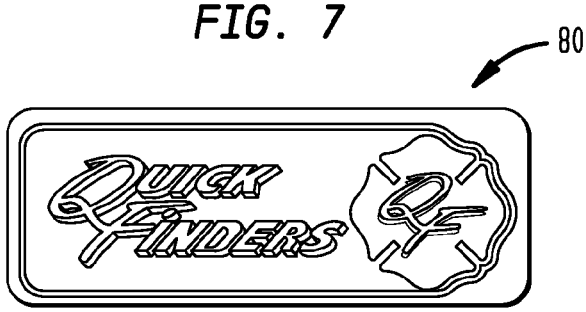
FIG. 7 is a plan view of an exemplary decal for use in accordance with the present invention.
Figure 8:
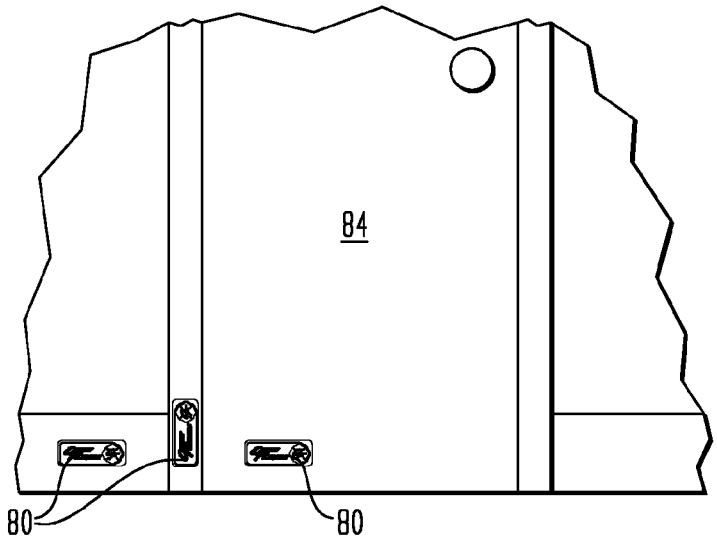
FIG. 8 is an elevational view showing an exemplary mounting of the sticker of FIG. 7 in accordance with the present invention.
Figure 9:
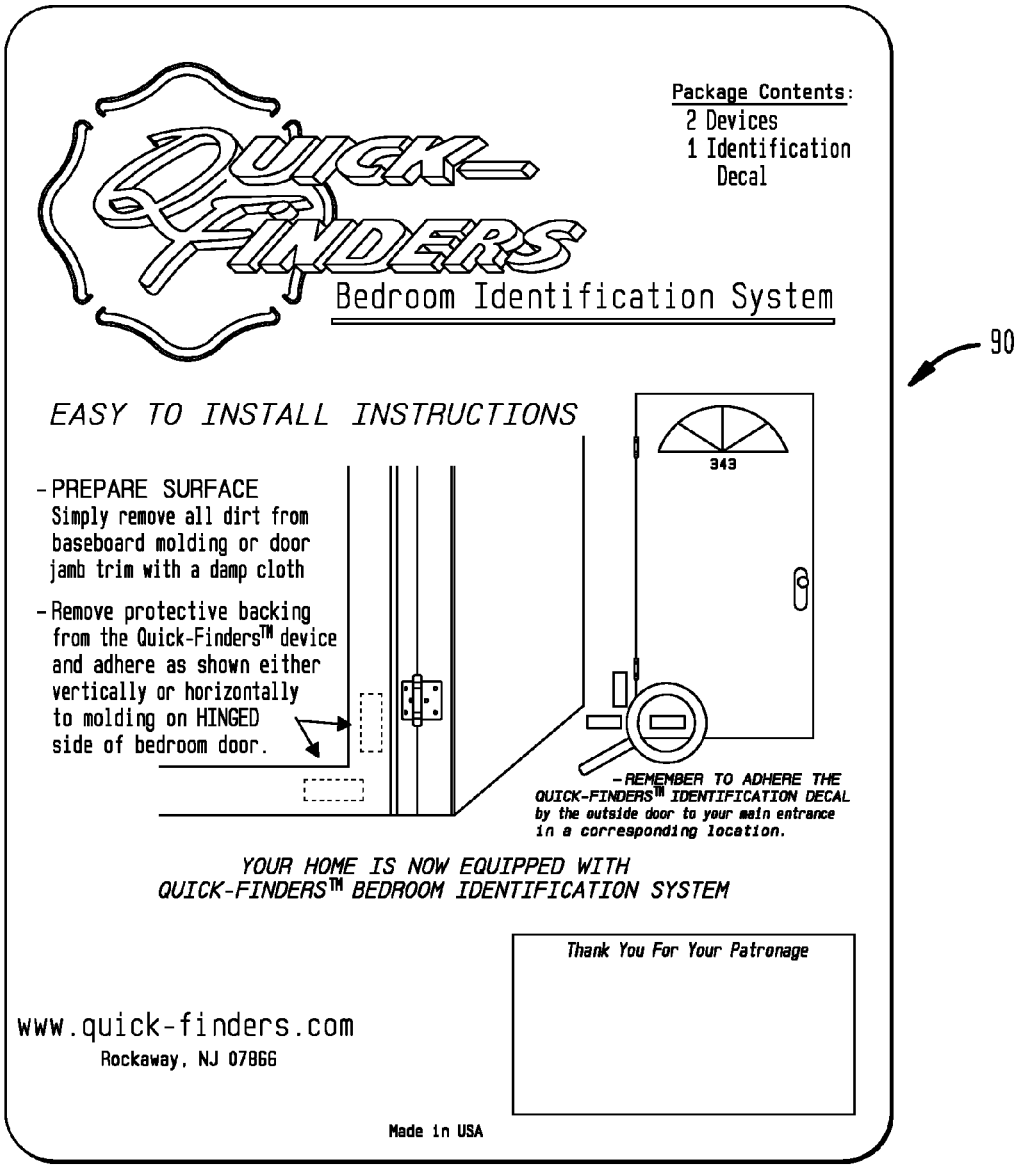
FIG. 9 is an image of exemplary instructions for installation of guidance devices and stickers in accordance with the present invention.

FIG. 6 is a perspective view showing an exemplary mounting of the guidance device 10 to residential structure, in accordance with the present invention. As shown in FIG. 6, a guidance device 10 is preferably mounted to an internal portion of the residence such that the guidance device 10 are observable only from an interior of a residence, thereby avoiding the aforementioned problem with predators and pedophiles. The guidance devices 10 may be mounted adjacent any rooms where potential fire victims are likely to be found, such as bedrooms. For any such room, the guidance device 10 is preferably mounted adjacent the room's doorway 50 on the external side 52 of the room's door 54. For example, such a device 10 may be mounted to baseboard 60 or casing 62 molding in a hallway leading to a bedroom, as shown in FIG. 6. Further, the devices 10 are preferably mounted in a consistent location relative to each marked door within a residence, e.g. adjacent the hinged side 56 of the door, near the floor. Preferably, the devices 10 are sold in kit form along with a reflective identification marker, such as sticker 80, of FIG. 7, that will serve as notice to the firefighter that the home is equipped with the guidance device 10. Further, the sticker 80 should be that should be mounted adjacent an entry door 84 of the residence in a location relative to the entry door 84 that corresponds to the locations of the guidance devices 10 relative to their respective doors within the residence (e.g. on or near the door, near the floor), as shown in FIGS. 8 and 9. Instructions 90 including text and/or illustrations may be provided to advise an installer of the guidance devices to mount the guidance devices 10 and sticker 80 in this manner, as shown in FIG. 9. Accordingly, the firefighter, will be able to determine from the sticker 80 on the outside of the residence the expected location of any guidance devices within the residence (e.g. near the floor), and the expected location of corresponding doorknobs 58 (see FIGS. 6 and 8) relative to each guidance device 10 (e.g. opposite the side of the door nearest the guidance device when the guidance device is located adjacent the hinged side of the door). In this manner, the guidance devices 10 will enable firefighters to reduce the amount of time necessary to locate bedrooms, victims, etc. when searching for persons trapped in a burning or smoke-filled building. The time saved will reduce the casualties of both residents and firefighters. Further, use of the guidance devices can further help reduce firefighter casualties by identifying bedrooms; firefighters are trained to look for bedrooms in the event the firefighter needs to quickly exit a smoke-filled/burning building because bedrooms typically have at least one window large enough that it can be used by the firefighter as an exit.

Figure 10:
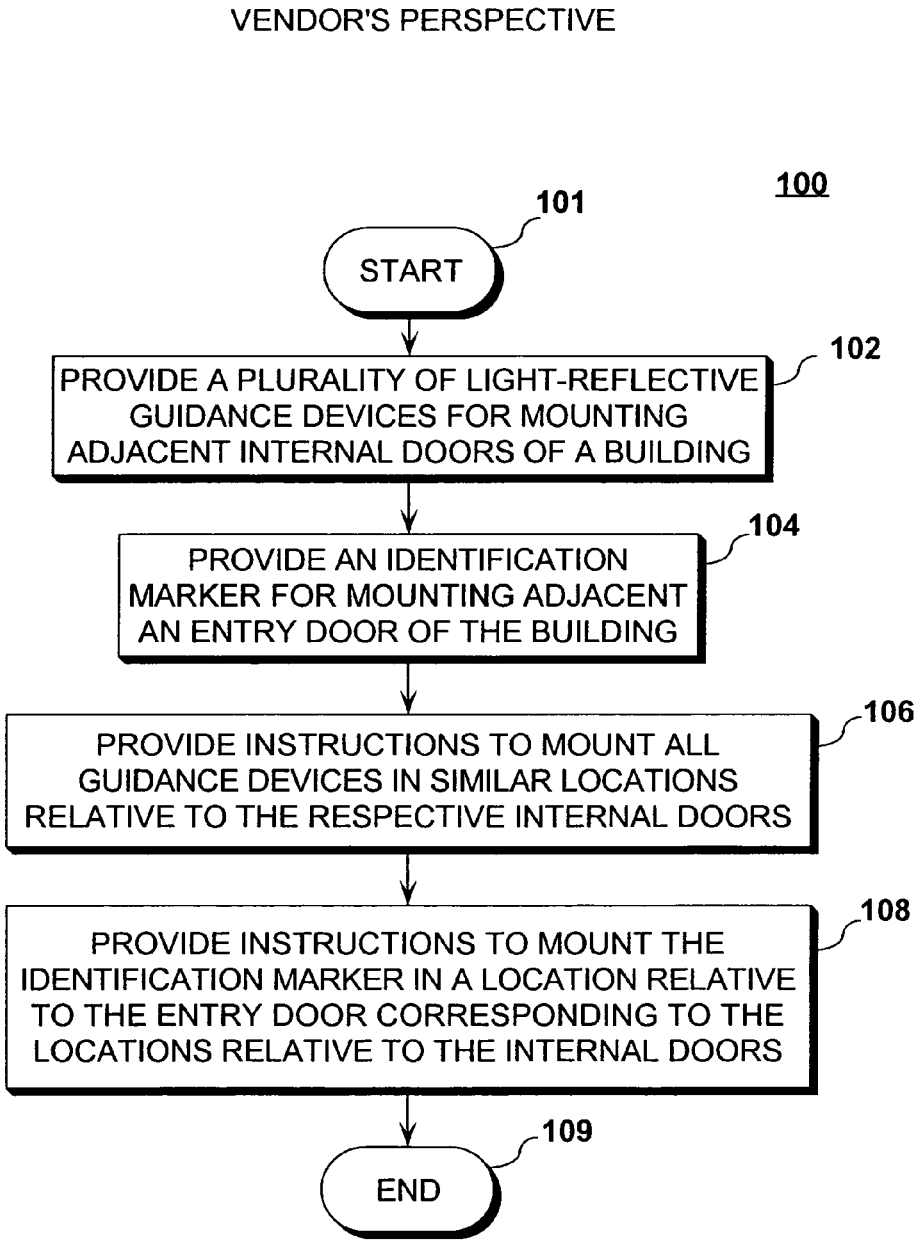
FIG. 10 is a flow diagram showing an exemplary method for providing a guidance system in accordance with the present invention.
Figure 11:
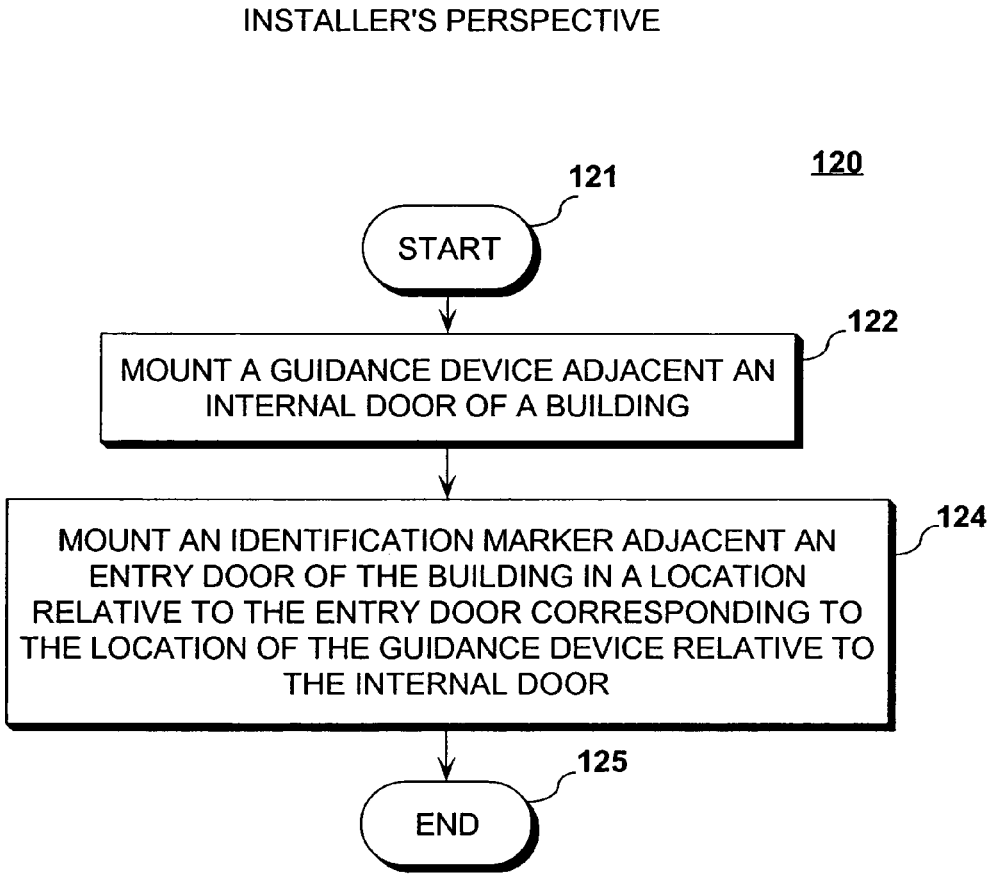
FIG. 11 is a flow diagram illustrating an exemplary method for installing a guidance system in accordance with the present invention.
Figure 12:
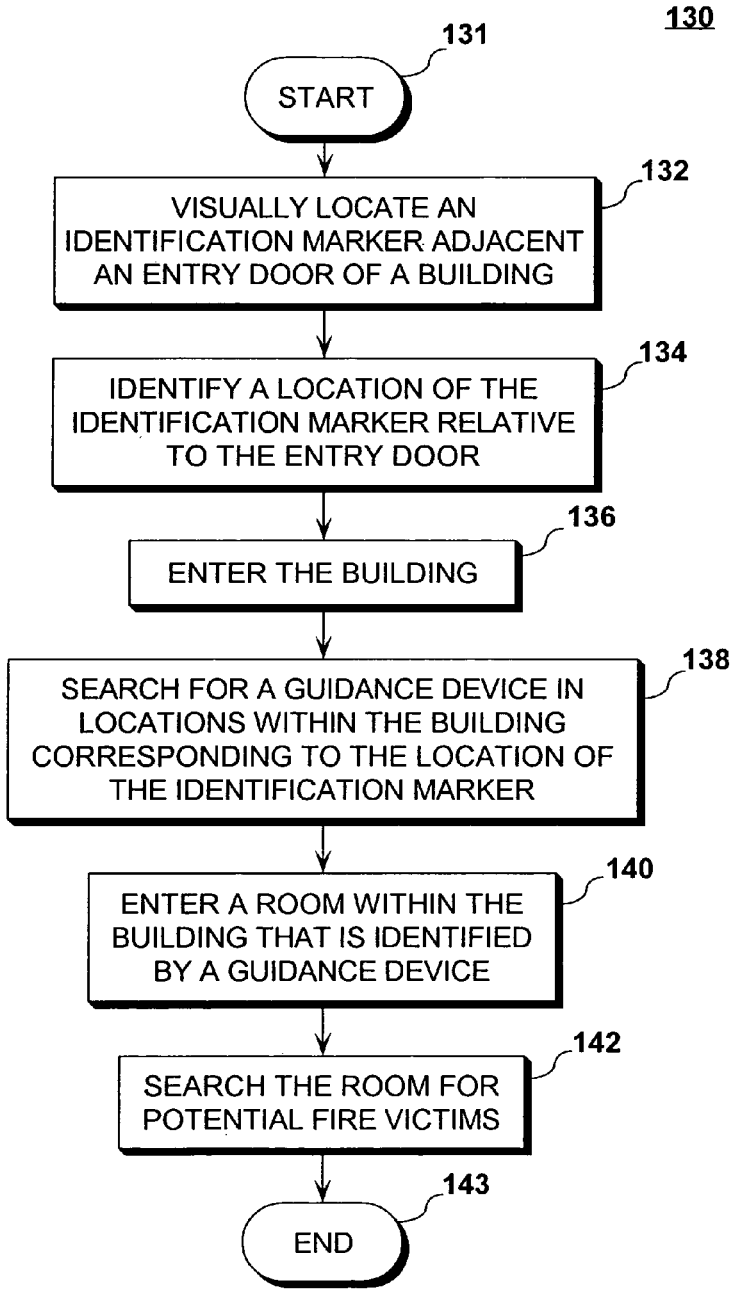
FIG. 12 is a flow diagram illustrating an exemplary method for using a guidance system in accordance with the present invention.

FIGS. 10, 11 and 12 show flow diagrams illustrating exemplary methods for providing, installing and using, respectively, a guidance system in accordance with the present invention. Referring now to FIG. 10, the flow diagram 100 shows an exemplary method for providing a guidance system from a vendor's perspective. As shown in FIG. 10, the method begins with providing of a plurality of guidance devices, such as the light reflecting and/or thermal imaging sensitive and/or electronic guidance devices discussed above, as shown at steps 101 and 102. Such guidance devices 10 (see, e.g. FIG. 1) are provided for mounting adjacent to an internal door of a building, as discussed above (see, e.g. FIG. 6). For example, the guidance devices may be mounted adjacent bedrooms or other rooms where potential victims are likely to be found in the event of a fire. Further, the method involves providing an identification marker, such as sticker 80 of FIG. 7 for mounting adjacent an entry door of the building, as shown at step 104 (see FIGS. 8 and 9). Further, the exemplary method includes providing instructions (see FIG. 9) to mount all guidance devices in similar locations relative to the respective internal doors, as shown at step 106. Finally, the exemplary method ends with providing of instructions to mount the identification marker in location relative to the entry door that corresponds to the locations of the guidance devices relative to the internal doors, as shown at steps 108 and 109. In this manner, a firefighter can observe the placement of the sticker 80 external to the building and determine where any guidance devices 10 in the building will likely be found. This allows the firefighter to conduct a preliminary search relatively quickly, and to conduct a detailed search in those areas where potential victims are most likely to be found.

Referring now to FIG. 11, a flow diagram 120 is shown that illustrates an exemplary method for installing a guidance system, shown from the perspective of an installer, such as a homeowner, policeman, firefighter, or installation professional. As shown in FIG. 11, the method begins with mounting of a guidance device 10 adjacent an internal door of a building, as shown at steps 121 and 122. As described above, the guidance device may include an adhesive tape backing covered by a release sheet 36. Accordingly, this mounting step 122 may include removing the release sheet 36 from a guidance device 10. Further, this mounting step 122 may include positioning the guidance device 10 in a predetermined location (such as on casing or baseboard molding near the floor, adjacent a hinged edge of a door, on an exterior side of the door relative to a room accessible thereby, etc.) relative to a door and/or selecting a room where a potential fire victim is likely to be found, etc (see FIG. 6). The exemplary method of FIG. 11 ends with mounting of an identification marker on or adjacent an entry door of the building in a location relative to the entry door that corresponds to the location of the guidance device relative to the internal door, as shown at steps 124 and 125 (see FIGS. 8 and 9). In this manner, a guidance system is provided that will provide notice to firefighters or other rescue personnel that the building contains the guidance device 10, will alert the rescue personnel to the expected location of such guidance device 10 and/or alert the rescue personnel to the location of doorknobs, etc. relative to any guidance device 10, etc.

Referring now to FIG. 12, a flow diagram 130 is shown that illustrates an exemplary method for using a guidance system, shown from the perspective of rescue personnel. As shown in FIG. 12, the method starts with visually locating an identification marker (such as sticker 80 of FIG. 7) adjacent (e.g. on or next to) an entry door of a building, as shown at steps 131 and 132 (see FIGS. 8 and 9). Next, the method includes identifying a location of the identification marker (sticker 80 FIG. 7) relative to the entry door, as shown at step 134. For the example of FIG. 9, a trained firefighter would take note in this step that any guidance device found within the building will be located at or just above a point at which the floor meets the wall, adjacent an edge of the door that is hinged (opposite the edge having the doorknob), and on an external side (the side not within the room marked by the guidance device) of the corresponding door. Having taken note of such location, the firefighter, etc. may then enter the building and conduct a search for guidance devices 10, as shown at steps 136 and 138. Advantageously, the search may focus on, or begin with, the areas where guidance devices will most likely be found, e.g. near the floor/wall juncture. For example, the search may be conducted with the use of flashlights or thermal imaging cameras, as discussed above. When a guidance device 10 is found, the firefighter, etc. may then enter the associated room and conduct a thorough search for potential fire victims, as shown at steps 140, 142 and 143. In this manner, search and rescue efforts may be focused, or at least initiated, where potential victims are most likely to be found.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A guidance device for assisting rescue personnel, said guidance device comprising:

a body having a top side and a bottom side opposite said top side, said body comprising a plurality of reflective fields, each of said plurality of reflective fields having a unique light-reflective characteristic; and a mounting member for securely mounting the guidance device to a surface.

2. The guidance device of claim 1, wherein reflective fields comprise:

a pair of wide angle reflectors, said pair of wide angle reflectors being spaced from one another and comprising three-dimensional structures oppositely oriented relative to one another; and a flat reflector positioned between respective ones of said pair of wide angle reflectors.

3. The guidance device of claim 1, wherein each reflective field comprises a plurality of reflective surfaces, each respective plurality of reflective surfaces being disposed at a certain orientation relative to said body, reflective surfaces of different reflective fields being disposed at different orientations relative to said body.

4. The guidance device of claim 3, wherein said surfaces of said reflective fields are arranged symmetrically about a first plane.

5. The guidance device of claim 4, wherein said surfaces of said reflective fields are arranged symmetrically about a second plane perpendicular to said first plane.

6. The guidance device of claim 3, wherein said reflective fields collectively include surfaces disposed at multiple unique orientations relative to said body.

7. The guidance device of claim 3, said plurality of reflective surfaces disposed at a certain orientation relative to said body define a plurality of adjacent prisms disposed to reflect incident light.

8. The guidance device of claim 7, wherein prisms of said plurality of prisms are disposed in a first orientation within a first of said reflective fields, and wherein prisms of said plurality of prisms are disposed in a second orientation within a second of said reflective fields.

9. The guidance device of claim 1, further comprising an element capable of absorbing heat for detection by a thermal imaging camera, said element being constructed of a material capable of absorbing heat more readily than a material from which said body is constructed.

10. The guidance device of claim 9, wherein said element comprises a metal disc having a diameter of approximately 0.89 inches and a thickness of approximately 0.05 inches.

11. The guidance device of claim 9, said body further comprising a recess dimensioned to receive and retain said element.

12. The guidance device of claim 11, said top surface of said body comprising a dome opposite said recess.

13. The guidance device of claim 1, further comprising:

a light source connected to a power source;

a light sensor for detecting light; and circuitry configured to cause emission of light from said light source responsive to detection of light by said light sensor.

14. The guidance device of claim 1, wherein said mounting member comprises adhesive tape having a first side adhered to a bottom side of said body, and a second side opposite said first side, said second side comprising adhesive for mounting said guidance device to the surface.

15. A guidance system kit comprising:

the guidance device of claim 1; and an identification marker capable of being mounted adjacent an entry door of a building, said identification marker comprising visually perceptible indicia providing notice that the building contains at least one guidance device.

16. The kit of claim 15, further comprising:

instructions bearing indicia advising an installer to mount said guidance device at a first location relative to an internal door of the building, and to mount said identification marker adjacent the entry door of the building at a second location relative to the entry door that corresponds to the first location relative to the internal door.

17. The guidance device of claim 1, wherein each of said plurality of reflective fields comprises a plurality of three-dimensional prismatic structures configured to reflect incident light in a direction substantially parallel to a direction of incidence for a range of angles, each of said plurality of reflective fields having a respective unique orientation of its respective plurality of light reflective surfaces, each respective unique orientation providing a corresponding unique light-reflective characteristic, said plurality of reflective fields having respective unique light-reflective characteristics.

18. A method for assisting rescue personnel to locate potential fire victims in a building, the method comprising:

providing a plurality of light-reflecting guidance devices for mounting adjacent internal doors of a building where potential fire victims will likely be found;

providing an identification marker for mounting adjacent an entry door of the building;

providing instructions to mount all guidance devices in a predetermined location relative to each respective internal door; and providing instructions to mount the identification marker in a location relative to the entry door that is similar to the predetermined location.

19. A method for searching for potential fire victims in a building, the method comprising:

entering the building;

searching for a guidance device positioned within the building;

identifying the guidance device;

identifying a doorway adjacent the guidance device, the doorway being internal to the building;

entering a room via the doorway; and searching the room for potential fire victims.

20. The method of claim 19, wherein the guidance device comprises a plurality of three-dimensional light-reflecting structures, and wherein said searching comprises directing a beam of light about the building to cause light to reflect from the guidance device.

21. The method of claim 19, wherein the guidance device comprises an element capable of absorbing heat for detection by a thermal imaging camera, and wherein said searching comprises using the thermal imaging camera to visually identify the element of the guidance device.

22. The method of claim 19, further comprising:

visually locating an identification marker adjacent an entry door of a building; and identifying a location of the identification marker relative to the entry door;

wherein said searching comprises seeking the guidance device in locations corresponding to the location of the identification marker relative to the entry door.

23. The method of claim 22, further comprising identifying a position of a doorknob of the entry door relative to the identification marker, wherein said searching comprises seeking a respective doorknob of a respective door adjacent the guidance device in a position corresponding to the position of the doorknob of the entry door relative to the identification marker.

24. A method for assisting rescue personnel to locate potential fire victims in a building, the method comprising:

providing a plurality of light-reflecting guidance devices for mounting adjacent internal doors of a building where potential fire victims will likely be found; and providing instructions to mount each of the plurality of guidance devices at a predetermined location relative to a respective internal door, said predetermined locations being consistent relative to the internal doors.

25. A guidance system kit for assisting rescue personnel, said guidance system kit comprising:

a plurality of guidance devices, each guidance device comprising a body including a reflective field having a light-reflective characteristic, each of said plurality of guidance devices further comprising adhesive for securely mounting the guidance device to a surface; and instructions bearing indicia advising an installer to mount each of said plurality of guidance devices at a predetermined location relative to a respective doorway to a room, the predetermined location being adjacent to the doorway and external to the room, the predetermined locations being consistent relative to the doorways.

26. The guidance system kit of claim 25, wherein the doorways correspond to internal doors of a residence.

* * * * *